United States Patent [19]

Womack

[11] Patent Number: 4,944,177

[45] Date of Patent: Jul. 31, 1990

[54] AUTOMOBILE LOCK CAP CLINCHER

[76] Inventor: Robert C. Womack, 5119 Radbrook Pl., Dallas, Tex. 75220

[21] Appl. No.: 356,016

[22] Filed: May 22, 1989

[51] Int. Cl.[5] ..... B25B 27/14

[52] U.S. Cl. ..... 72/410; 81/15.9; 81/427.5; 29/511; 29/243.517

[58] Field of Search ..... 72/409, 410; 81/15.9, 81/421, 427.5; 29/243.52, 243.57, 243.5, 283.5, 804, 511, 270; 70/381, 452, 237, DIG. 56, DIG. 43

[56] References Cited

U.S. PATENT DOCUMENTS

| | | | |
|---|---|---|---|
| 331,812 | 12/1885 | Norris | 81/421 |
| 355,144 | 12/1886 | Dalzell | 29/243.52 |
| 886,401 | 5/1908 | Pickett | 72/409 |
| 1,722,279 | 7/1929 | Davis | 72/409 |
| 1,965,940 | 7/1934 | Jacobi | 29/511 |
| 2,415,896 | 2/1947 | Marsh et al. | 29/243.52 |
| 2,488,484 | 11/1949 | Vander Clute | 81/421 |
| 3,082,652 | 3/1963 | Marti | 81/427.5 |
| 4,360,284 | 11/1982 | Brandenburg | 29/511 |

FOREIGN PATENT DOCUMENTS

| | | | |
|---|---|---|---|
| 1003658 | 2/1957 | Fed. Rep. of Germany | 72/409 |

*Primary Examiner*—Daniel C. Crane
*Attorney, Agent, or Firm*—Warren H. Kintzinger

[57] ABSTRACT

A replacement metal cap clinching tool for recapping automobile door and trunk lock cylinders. The tool has a base, that may be mounted in a bench vice, having a cap receiving pocket that has a resiliently compressible rubber cushion seated in the bottom thereof and upon which replacement metal cap is placed that receives the head end of a lock cylinder that is to be recapped. Two opposing handles that are each pivotal pin mounted in the tool base, are each formed with an inwardly directed clinching nose that engage respective opposite side cap tabs aligned therewith that are first bent inwardly by the handle clinching noses that translate with continued handle inward rotation to a semi-vertical action with final crimping action of tabs with force reaction through the lock cylinder and the cap resiliently compressing the rubber cushion in the tool. With each cap having two sets of equally spaced opposite side tabs after the first set of tabs on a replacement lock cap is clinched the clinching handles are retracted and lock and cap are rotated ninety degrees and the manual crimping process is repeated.

7 Claims, 1 Drawing Sheet

AUTOMOBILE LOCK CAP CLINCHER

Figure 1:
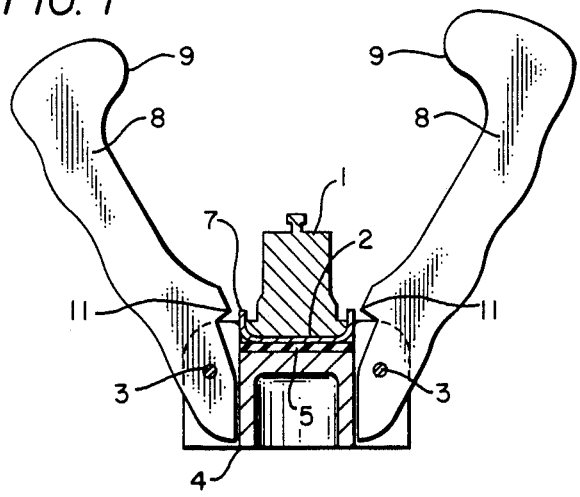

This invention relates in general to automobile lock cap fastening, and more particularly, to a replacement metal cap clinching tool used in recapping automobile door and trunk lock cylinders.

Most automobile door and trunk locks come from the factory with a metal cap rolled over all around the head of the lock. Locksmiths must peel this metal cap off, and after working on the interior of the lock a new cap is required, as the old cap cannot be removed easily without destroying it. Replaceable lock caps are sold by most automobile lock manufacturers and the replacement caps have four one quarter inch wide tabs about one eighth of an inch long. In operation, the lock cylinder is set into the replacement cap and in the past the locksmith bent the four tabs over with a screw driver, hammer or pliers. These methods leave a lot to be desired, in that they scratch the cap face, are hard to do properly, and many people let the screwdriver slip and punch their fingers. The caps are rarely tight when the above methods are used.

It is therefore a principal object of this invention to provide an easy to use efficient manually actuated lock cylinder replacement cap clinching tool.

Another object is to provide such a tool with two crimping handles grasped by and squeezed by one hand.

A further object is to provide such a tool operable in two squeeze crimping motions for each recapping of a lock cylinder with the cylinder and cap rotated ninety degrees between each crimping motion.

Features of the invention useful in accomplishing the above objects include, in a replacement metal cap clinching tool for recapping automobile door and trunk lock cylinders, a tool made of of plastic, metal or a combination of materials. It has a body that may be hand held or clamped in a vice, and a pocket with a rubber bottom cushion that fits the lock cap to be clinched on the lock cylinder. There are two opposing handles hinging on two pins. After placing the lock cap, with cylinder lock in it, in the pocket of the tool, both the tool handles are squeezed together with one hand while the lock and cap are held down with the fingers of the other hand. After clinching two of the tabs on the replacement lock cap, the handles are retracted and the lock and cap are rotated ninety degrees and the process is repeated.

One key to the operation of this tool is the location of the hinge pins for the handles in relation to the lock body and cap tabs. The pins are positioned so that the clinching nose of the handles bends the tabs in and as the tabs are folded in and down, the clinching nose of the handles changes, due to the arc, from a lateral movement to a semi-vertical movement pushing down on the cap tabs against the rubber cushion in the tool cap pocket. The rubber cushion lets the cap and lock body move down and a downward clinching of the lock cap tabs is achieved. This method gives a very tight clinch on the tabs and is so easy, due to the handle leverage, that anyone, even one not skilled in the trade, can do a good job quickly. The tool is designed so that when the clinching is done the air gap between the handles will be only about one quarter of an inch. Thus if the operator squeezes the handles too tightly they come together before they would break.

The tool is light and small and can be operated clamped in a vice with two shoulders to locate the tool in the vice, or held in the operator's hand, and operated. The main parts are readily molded from plastic or other materials with this allowing the price to be in a range that can be afforded by workmen. In summary this tool makes it easy for a person to do a good job, quickly, in replacing caps on automobile lock cylinders after working on the lock. The tool is readily portable, inexpensive, and there is a need for this tool in the trade.

A specific embodiment representing what is presently regarded as the best mode of carrying out the invention is illustrated in the accompanying drawing.

Figure 2:
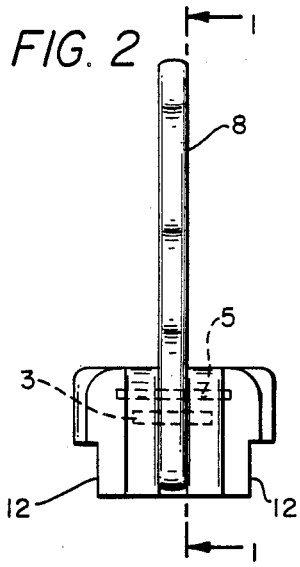
Figure 3:
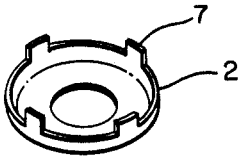
Figure 4:
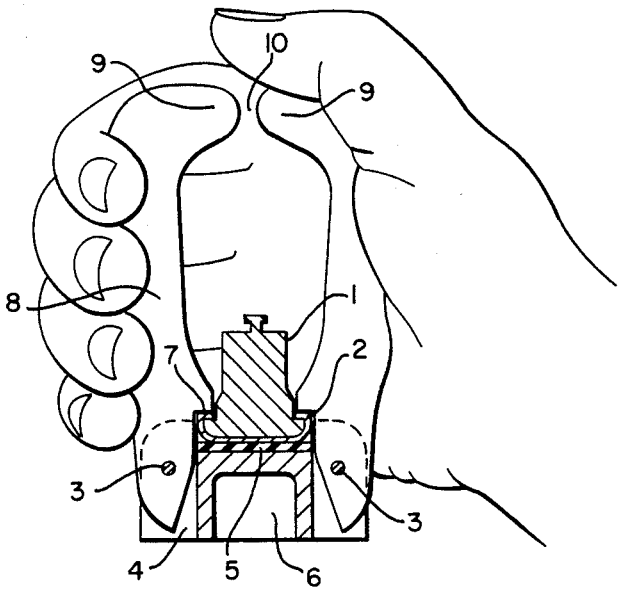

In the drawing:

FIG. 1 represents a partially cut away along line 1—1 of FIG. 2 and sectioned front elevation view with a lock cylinder positioned on a cap seated on a rubber cushion in the tool for crimping of cap tabs on the cylinder;

FIG. 2, a side elevation of the cap clinching tool with a body base having opposite sides and shoulders for being held in a bench vice;

FIG. 3, a perspective view of a replacement cap with two sets of opposite side tabs such as used by locksmiths when recapping an automobile lock cylinder after reworking the lock cylinder, such as re-keying the lock; and, FIG. 4, a front elevation partially sectioned view like FIG. 1 with the tool hand squeezed to crimp a set of opposite side tabs of the replaceable cap on a cylinder head.

Referring to the drawings:

An automotive lock cylinder 1 is shown in FIG. 1 positioned on the interior of a lock cap 2 held in a pocket in tool body 4 seated on rubber cushion 5. Opposite side handles 8 are pivotally mounted (referring also to FIG. 2) in opposite side slots in tool body 4 by two pins 3 with the clinching noses 11 of each handle 8 in position to engage a set pair of opposite side cap tabs 7 and then clinch the cap tabs 7 as the handles 8 are being manually hand squeezed together as shown in FIG. 4. Two cycles of hand squeezing will clinch the four tabs 7 of the replaceable automobile lock cap 2, as shown in FIG. 3, over the head of lock cylinder 1, first one set of tabs 7 and then after turning the cap 2 and cylinder 1 ninety degrees the other set of tabs 7. The handle 8 mounting pins are so located in the tool body 4 as to result in the handles 8 being moved laterally at the start of their squeeze movement and then the clinching noses 11 rotate to a semi-vertical downward movement action clinching the tabs 7 engaged thereby. With the continued manual hand squeeze action the lock cylinder and cap are pressed down resiliently compressing the rubber cushion 5 held in the upper pocket of the tool body 4. It should be noted, as shown in FIG. 2, that the clamping clinching action tool body 4 is provided with two opposite side notches 12 for ease of clamping the tool in a bench vice.

Referring again to the handle squeezed state of the tool as shown in FIG. 4 the tab 7 crimp actuated position of lock cylinder 1 and cap 2 is with two of the four tabs 7 clinched over the head of lock cylinder 1. Bottom cavity 6 in tool body 4 is a hole lightening the tool by removing weight. Please note that top handle 8 inwardly directed stop extensions 9 limit over travel after cap tab 7 clinching to a travel limit spacing 10 so that handles 8 would not be over stressed and break.

Whereas this invention has been described with respect to a single embodiment thereof, it should be realized that various changes may be made without departure from the essential contributions to the art made by the teachings hereof.

I claim:

1. A cap clinching tool used for clinching metal caps in recaping automobile door and truck lock cylinders comprising: a tool base having an upper cylindrical pocket for receiving a cap, with sets of opposite side tabs, and a lock cylinder with a head end about which tabs of the cap are clinched by the tool; two opposing handles each pivotally mounted by pivot mount means in said tool base on opposite sides of said upper cylindrical pocket; and each of said two opposing handles being formed with an inwardly directed clinching nose mounted above the pivot center of the handle about its pivot mount means, and positioned to engage respective opposite side cap tabs aligned therewith bending the tabs initially inwardly and then progressively down as the clinching nose of each handle moves through an arc from a lateral movement to a semi-vertical movement pushing down on the cap tabs engaged by the inwardly directed clinching noses of the opposing handles as they are squeezed toward each other by a user's hand.

2. The cap clinching tool of claim 1, wherein said pivot mount means for said two opposing handles are pivot pin mountings at the bottoms of said handles in said tool base; opposite side slots in said tool body with pivot pins extended through said slots, said handles and into opposite sides of said opposite side slots of said tool base.

3. The cap clinching tool of claim 2, wherein a cushion of resiliently compressible material is mounted in the bottom of the upper cylindrical pocket in said tool base.

4. The cap clinching tool of claim 3, wherein said cushion is a circular disc of resiliently compressible rubber.

5. The cap clinching tool of claim 3, wherein said two opposing handles have inwardly directed stop extensions aligned to come into abutting engagement and limit handle squeeze over travel after cap tab clinching cycles.

6. The cap clinching tool of claim 3, wherein two opposite side notch cuts are provided in said tool base for ease of clamping the tool in a bench vice.

7. The cap clinching tool of claim 3, wherein said tool base and said two opposing handles are plastic components.

* * * * *